US009006555B2

(12) United States Patent
Mori

(10) Patent No.: US 9,006,555 B2
(45) Date of Patent: Apr. 14, 2015

(54) PERCUSSION INSTRUMENT APPARATUS, SYSTEM AND PROCESS

(75) Inventor: Yoshiaki Mori, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 168 days.

(21) Appl. No.: 13/571,267

(22) Filed: Aug. 9, 2012

(65) Prior Publication Data

US 2013/0180388 A1 Jul. 18, 2013

(30) Foreign Application Priority Data

Jan. 12, 2012 (JP) ..... 2012-004368

(51) Int. Cl.
*G10H 1/32* (2006.01)
*G10H 3/00* (2006.01)
*G10H 3/14* (2006.01)

(52) U.S. Cl.
CPC ..... *G10H 3/14* (2013.01); *Y10T 29/49574* (2013.01); *G10H 2230/301* (2013.01); *G10H 3/146* (2013.01)

(58) Field of Classification Search
CPC ..... G01H 1/32; G01H 3/06; G01H 3/10; G01H 3/12; G01H 3/146; G01H 2220/525; G01H 2230/275; G01H 2230/281; G01H 2230/301; G01H 2250/435; G10D 13/02; G10D 13/024; G10D 13/027
See application file for complete search history.

(56) References Cited

U.S. PATENT DOCUMENTS 5,920,026 A * 7/1999 Yoshino et al. ..... 84/738
6,121,538 A * 9/2000 Yoshino et al. ..... 84/738
6,271,458 B1 * 8/2001 Yoshino et al. ..... 84/738
6,525,249 B1 2/2003 Suenaga
6,756,535 B1 * 6/2004 Yoshino et al. ..... 84/738
6,784,352 B2 8/2004 Suenaga
6,921,857 B2 * 7/2005 Yoshino et al. ..... 84/738
7,038,117 B2 * 5/2006 Yoshino ..... 84/411 R
7,385,135 B2 * 6/2008 Yoshino et al. ..... 84/738
7,525,032 B2 4/2009 Mishima
7,612,273 B2 11/2009 Matsuyuki et al.
7,667,130 B2 2/2010 Mishima
8,173,886 B2 5/2012 Hashimoto
8,431,813 B2 * 4/2013 Mori ..... 84/723
8,563,843 B1 * 10/2013 Shemesh ..... 84/743
2004/0083873 A1 * 5/2004 Yoshino et al. ..... 84/107
2009/0000464 A1 * 1/2009 Mishima ..... 84/724
2010/0307323 A1 * 12/2010 Mori ..... 84/723
2013/0180388 A1 * 7/2013 Mori ..... 84/723
2014/0020548 A1 * 1/2014 Shemesh ..... 84/626

FOREIGN PATENT DOCUMENTS

JP 10-020854 1/1998
JP 10-198375 7/1998
JP 11-173876 A 7/1999

(Continued)

*Primary Examiner* — Marlon Fletcher

(74) *Attorney, Agent, or Firm* — Foley & Lardner LLP

(57) ABSTRACT

A percussion instrument that suppresses erroneous detection by a rim sensor includes a first plate affixed to a frame, a second plate elastically supported on the first plate by one or more elastic members, and a rim sensor attached to the second plate. Large vibrations of the frame from an impact of a strike on the rim are transmitted to the second plate, and the rim sensor provides an output corresponding to the striking force. Also, vibrations of the frame generated by striking sound or external sound is attenuated by the elastic member, to suppress transmission of such vibrations to the second plate.

30 Claims, 6 Drawing Sheets

(56) References Cited

FOREIGN PATENT DOCUMENTS

| | | |
|---|---|---|
| JP | 2001-142459 | 5/2001 |
| JP | 2004-198657 | 7/2004 |
| JP | 2007-114722 | 5/2007 |
| JP | 2007-249140 | 9/2007 |
| JP | 2007-249141 | 9/2007 |
| JP | 2009-222758 | 10/2009 |
| JP | 2010-282157 | 12/2010 |

* cited by examiner ( a )

( b )

PERCUSSION INSTRUMENT APPARATUS, SYSTEM AND PROCESS

CROSS-REFERENCE TO RELATED PATENT APPLICATIONS

Japan Priority Application No. 2012-004368, filed on Jan. 12, 2012, including the specification, drawings, claims and abstract, is incorporated herein by reference in its entirety.

FIELD OF THE INVENTION

Embodiments of the present invention relate, generally, to percussion instruments, components of percussion instruments, processes of making and using such percussion instruments and systems employing such percussion instruments. Particular embodiments of the invention relate to percussion instrument systems, apparatuses and processes that employ a structure that is capable of suppressing erroneous detection of vibrations by a rim sensor.

BACKGROUND

Attempts have been made to configure an electronic percussion instrument in a manner to simulate an acoustic percussion instrument. For example, Japanese Laid-open Patent Application 2004-198657 describes an electronic percussion instrument 1 that includes a head 5, a rim 6, a shell section 2, a sensor frame 4, and a rim shot sensor 31. The head 5 has a striking surface. The rim 6 surrounds the head 5. The head 5 and the rim 6 are arranged in a manner to cover the shell section 2. The sensor frame 4 is formed in a container-like shape, and supported between the shell section 2 and the rim 6. The rim shot sensor 31 is directly attached to the sensor frame 4. Accordingly, when the rim 6 is struck, causing the rim 6 to vibrate, the vibration is transmitted from the rim 6 to the sensor frame 4 and is detected by the rim shot sensor 31. A controlled tone is generated based on the detected signal.

However, a conventional electronic percussion instrument 1 as described above can be influenced by external sound such as sound emanated from loudspeakers, because the surface area of the sensor frame 4 is relatively large. Therefore, even when the rim 6 is not struck, external sound propagated through the air can be transmitted to the sensor frame 4. As a result, the sensor frame 4 can vibrate due to resonance, which can cause erroneous detection of a strike on the rim 6 by the rim shot sensor 31.

SUMMARY OF THE DISCLOSURE

Embodiments of the present invention relate to an electronic percussion instrument that is capable of suppressing erroneous detections by a rim shot sensor.

An electronic percussion instrument according to an embodiment of the present invention includes an elastic member made of an elastic material disposed between a plate and a body section. In addition, a rim sensor is attached to the plate that is elastically supported on the body section.

Accordingly, vibrations of the body section from external sound propagating through the air, are buffered by the elastic member provided between the body section and the plate. Therefore, transmission of the vibrations of the body section to the plate can be reduced. As a result, erroneous detection of vibrations by the rim sensor can be suppressed.

Also, because the plate is elastically supported with respect to the body section, the plate can freely vibrate. Therefore, when the rim section is struck, an impact on the entire electronic percussion instrument from the strike on the rim section amplifies the vibration of the plate, while suppressing the transmission to the plate of vibrations of other members, such as the body section, generated from the impact of the strike on the rim. As a result, accurate outputs based on the force of the strike on the rim section can be obtained from the rim sensor.

As the elastic member is provided between the body section and the plate having the rim sensor attached thereto, the rim sensor can be substantially prevented from erroneously detecting vibrations of the body section caused by external sound. Further, vibrations transmitted to the entire electronic percussion instrument by the striking at the rim section, can be reliably detected.

According to further embodiments of a percussion instrument as described above, one end of a cushion is attached to a sensor connecting section, and the other end of the cushion is brought in pressure contact with the head. Therefore, vibrations of the sensor connecting section due to external sound propagating to the body section, can be attenuated by the cushion. Furthermore, the plate is elastically supported on the sensor connecting section by the elastic member. Therefore, vibrations of the sensor connecting section, which have been reduced by the cushion, can be further attenuated. In other words, transmission of the vibrations to the plate can be reduced. Accordingly, it is possible to suppress erroneous detection by the rim sensor of vibrations of the body section resulting from resonance generated by the propagating external sound.

Further, the sensor connecting section is affixed to the body section. Therefore, when the rim section is struck, the resulting relative displacements of the sensor connecting section with respect to the head, can be reduced. Accordingly, elastic deformation of the cushion located between the sensor connecting section and the head can be reduced and, thus, detection of the elastic deformation of the cushion by a head sensor can be suppressed, accordingly. As a result, erroneous detection by the head sensor when the rim section is struck, can be suppressed.

In this manner, when the rim section is struck, the plate can vibrate by the impact according to the striking force, and the vibration of the plate can be accurately detected by the rim sensor. On the other hand, erroneous detection by the head sensor can be suppressed. Therefore, it is possible to obtain outputs from the head sensor and the rim sensor that accurately reflect the performance intention of the performer when the head section alone is struck, when the rim section alone is struck, and when the head and the rim section are concurrently struck.

According to further embodiments of a percussion instrument as described above, the body section is formed in a cylindrical shape and the rim sensor is arranged in a central area of the cylindrical shape of the body section. Therefore, differences in the detection by the rim sensor, which may otherwise occur at different striking locations on the rim, can be suppressed.

If the rim sensor were arranged at a position that is offset from the center of the body section, differences in sound output by a sound output device would likely occur when the rim is struck by the same force, but at different distances between the location of the rim sensor and the location where the rim section is struck. Also, differences would likely occur in the time lag from the moment of striking to the output of sound.

In contrast, with the rim sensor disposed in the central area of the body section, the rim sensor can be disposed in the center of a circular, ring-shaped rim section. Therefore, sound output according to the striking force can be reliably made without regard to the striking location on the rim section. Moreover, the time lag from the moment of striking to the output of sound can be made constant, without regard to the striking location on the rim section.

According to further embodiments of a percussion instrument as described above, a plate surface contact area that the elastic member contacts on one surface of the plate is equal to ½ or less of the entire area of that surface of the plate, thus, minimizing the contact area between the plate and the elastic member. Accordingly, the plate is elastically supported on the body section in a state in which the plate can be readily vibrated. Therefore, vibrations of the body section corresponding to the striking force at the rim section, can be accurately detected by the rim sensor.

According to further embodiments of a percussion instrument as described above, the plate is elastically supported by the elastic members at three locations that are spaced apart at equal intervals in the circumferential direction. Accordingly, substantial differences in the output values of the rim sensor, due to differences in the locations where the rim section is struck, can be suppressed. In other words, if the plate was elastically supported by elastic members in two locations, the ease by which the plate vibrates at a location where the plate is elastically supported by an elastic member or in the proximity of a linear line extending between the elastic members, is significantly different from the ease by which the plate vibrates at locations distant there from. Also, a similar adverse effect can occur, if the plate is elastically supported by the elastic members at three or more locations, but the locations are positioned linearly or at irregular intervals. Therefore, the ease by which the plate vibrates would deviate, depending on the striking location where the rim section is struck. As a result, significant differences can occur in the output value of the rim sensor, depending on the ease by which the plate vibrates.

In contrast, when the elastic members are located at equal intervals in the circumferential direction, differences in the ease by which the plate vibrates dependent on the location from where the vibration is transmitted, can be reduced. In other words, it is possible to reduce differences in the output value of the rim sensor at different striking locations where the rim section is struck. Therefore, irrespective of the striking location where the rim section is struck, the plate can be reliably vibrated in correspondence with the force of strike. Therefore, vibration of the body section corresponding to the force of striking at the rim section can be reliably detected by the rim sensor.

According to further embodiments of a percussion instrument as described above, the plate is formed, generally, in a triangular shape, and the elastic member contacts the plate adjacent to each of the apexes of the plate. Accordingly, the shape of the plate is simplified, such that the cost of making the plate can be reduced. Furthermore, the surface area of the plate can be made smaller such that vibrations of the plate caused by external sound can be reduced. As a result, it is possible to suppress erroneous detection by the rim sensor of vibrations resulting from external sound.

BRIEF DESCRIPTION OF THE DRAWINGS

FIG. 2 (*b*) is a bottom plan view of the sensor section.

FIG. 2 (*c*) is a cross-sectional view of the sensor section taken along a line IIc-IIc of FIG. 2 (*a*).

FIG. 5 (*b*) is a scatter-graph plotting the results of a striking test performed with a comparison electronic percussion instrument.

DETAILED DESCRIPTION

Figure 1:
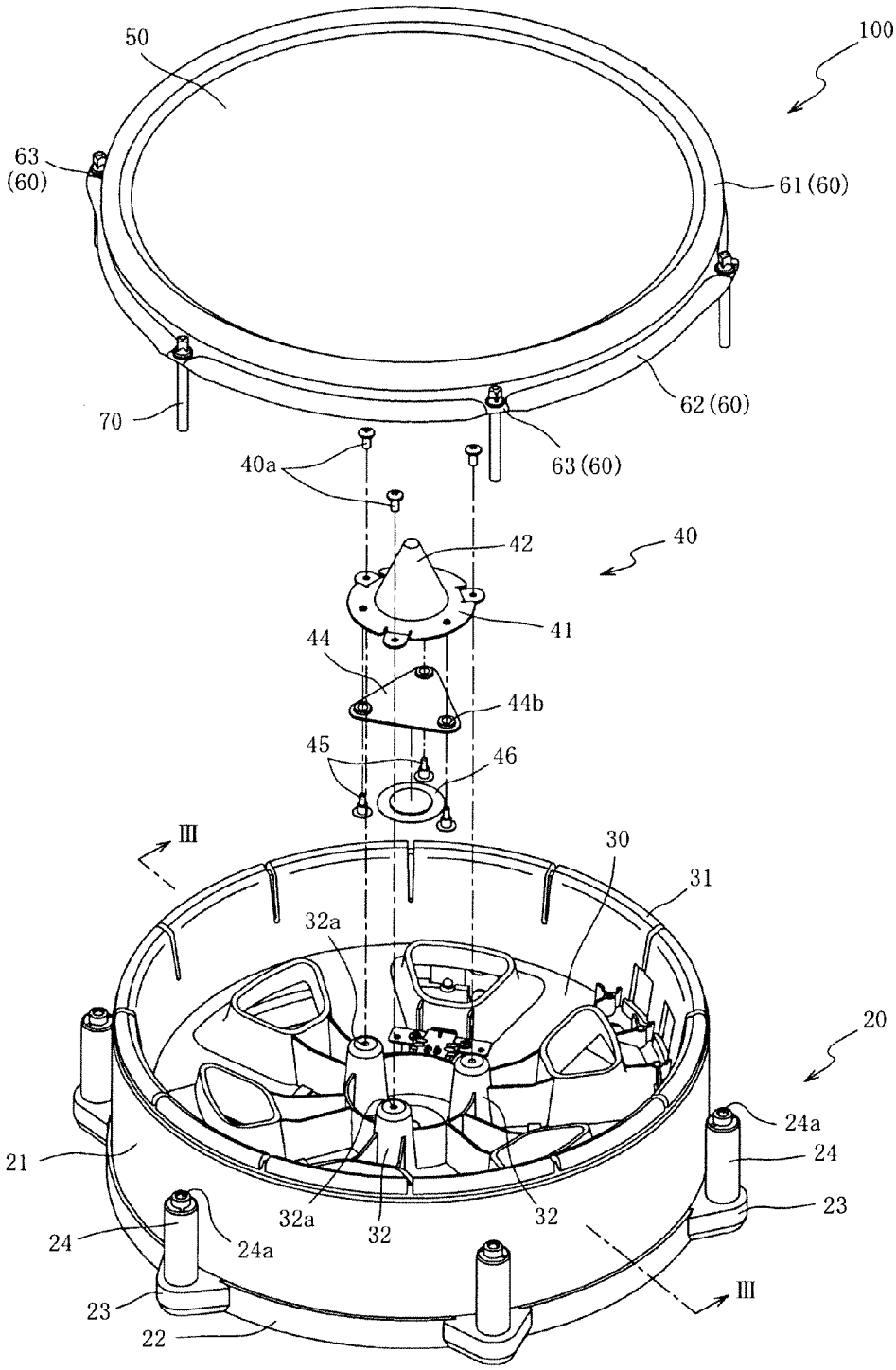
FIG. 1 is an exploded perspective view of an electronic percussion instrument in accordance with an embodiment of the invention.

Embodiments of the invention are described below with reference to the accompanying drawings. An example of an electronic percussion instrument 100 according to an embodiment of the present invention is shown FIG. 1.

The electronic percussion instrument 100 is a percussion instrument that may be performed using sticks or the like. The electronic percussion instrument 100 is provided with a main body 20, a frame 30, a sensor section 40, a head 50, a rim section 60 and bolts 70. The main body 20 is open on one side (the top side in FIG. 1). The frame 30 is arranged over the open side of the main body 20 and extends into the main body 20. The sensor section 40 is attached to the frame 30. The head 50 is supported in contact with the sensor section 40. The rim section 60 is retained at the outer circumferential portion of the head 50. The bolts 70 affix the rim section 60 to the main body 20.

The sensor section 40 includes a head sensor 43 (see FIG. 2) and a rim sensor 46 (described below) for detecting vibrations caused by strikes on the electronic percussion instrument 100. Further, the electronic percussion instrument 100 outputs detection signals to a tone device (not shown). The tone device controls a sound source based on the detection signals outputted from the sensor section 40, to generate audible tones according to the strikes. The generated tones are outputted from a sound output device such as a speaker (not shown), through an amplifier (not shown).

The main body 20 includes a cylindrical section 21, a bottom section 22, protruded sections 23, and screw attachment sections 24. The cylindrical section 21 has a cylindrical shape and is open on its upper and lower ends. The bottom section 22 has a circular ring shape that covers the lower end of the cylindrical section 21. The protruded sections 23 protrude outward in the radial direction from the bottom section 22. The screw attachment sections 24 are arranged upright on the protruded sections 23.

The cylindrical section 21 forms a side wall surface of the electronic percussion instrument 100. The screw attachment sections 24 are arranged on the protruded sections 23, around the outer peripheral side of the cylindrical section 21. In the illustrated example embodiment, six protruded sections 23 are provided at equal intervals in the circumferential direction of the bottom section 22. In other embodiments, other suitable numbers of protruded sections 23 (fewer or greater than six) are used. The screw attachment sections 24 are engaged, in a screw-threading manner, with the bolts 70. The lower end of each screw attachment section 24 is affixed to a respective one of the protruded sections 23. The upper end of each attachment section 24 has a female threaded section 24*a* that can be engaged, in a screw-threading manner, with the bolts 70.

The frame 30 may be made of a resin material, and has a bowl-like shape that is open on its top side. The frame 30 includes a flange section 31 and protruded sections 32. The flange section 31 extends outward in a flange shape at the outer circumferential edge of the frame 30. The protruded sections 32 protrude upward from a central section of the frame 30.

The flange section 31 fits over the upper end of the cylindrical section 21. The flange section 31 has an outer diameter that is greater than the inner diameter of the cylindrical section 21. The sensor section 40 is affixed to the protruded sections 32. In an example embodiment, three protruded sections 32 are formed at equal intervals in the circumferential direction of the frame 30. Further, each of the protruded sections 32 has an upper end having a female threaded section 32*a* that can be engaged, in a screw-threading manner, with screws 40*a*.

The sensor section 40 includes a sensor for detecting strikes on the percussion instrument 100. The sensor section 40 is affixed to the frame 30 by the screws 40*a* that are engaged with the female threaded sections 32*a* in the protruded sections 32 of the frame 30.

The head 50 forms a striking surface to be struck by the performer. A head frame 50*a* (see FIG. 3) has a circular ring shape and is affixed to the outer circumferential edge of the head 50. The head frame 50*a* may be made of any suitably rigid material, including but not limited to metal. The head frame 50*a* has an inner diameter that is greater than the outer diameter of the cylindrical section 21 of the main body 20 and the outer diameter of the flange section 31 of the frame 30.

The rim section 60 is a circular ring shaped member that applies tension to the head 50. The rim section 60 includes a silencer member 61, a head retaining section 62, and bolt retaining sections 63. The silencer member 61 is arranged to cover the top surface of the rim section 60. The head retaining section 62 extends outward, in a flange shape, from the lower end side of the rim section 60. The bolt retaining sections 63 are formed in the head retaining section 62 at equal intervals around the circumference of the head retaining section 62.

The silencer member 61 is configured to be struck by the performer. The silencer member 61 may be made of an elastic material to reduce the striking sound generated when the rim section 60 is struck. The head retaining section 62 retains the head frame 50*a* of the head 50 on the main body 20. The head retaining section 62 has an inner diameter that is greater than the outer diameter of the cylindrical section 21 of the main body 20, and smaller than the outer diameter of the head frame 51. The bolts 70 are retained in bolt retaining sections 63. The bolt retaining sections 63 are provided with holes through which the bolts 70 are passed.

Embodiments of the invention further relate to methods of assembling the electronic percussion instrument 100. A method according to an embodiment of the invention includes disposing the frame 30 over the upper end of the main body 20, with the flange section 31 being retained over the upper end of the cylindrical section 21. Next, the head 50 is disposed over the top side of the frame 30, and the head frame 50*a* is placed over the outer circumference side of the cylindrical section 21. Next, the head retaining section 62 of the rim section 60 is placed over the upper side of the head 50 and retained over the head frame 50*a*. Then, the bolts 70 are passed through the holes formed in the bolt retaining section 63, from the upper side of the rim section 60. The bolts 70 are engaged, in a screw-threading manner, with the female threaded sections 24*a* in the screw attachment sections 24 of the main body 20.

By tightening the bolts 70 in the female threaded sections 24*a*, the rim section 60 is pushed toward the bottom section 22 of the main body 20, to retain and affix the frame 30 between the rim section 60 and the cylindrical section 21. Further, the head frame 50*a* of the head 50 retained at the head retaining section 62 is pushed downward, such that a tension is applied to the head 50. The tension of the head 50 is adjusted by adjusting the amount by which the bolts 70 are tightened.

Figure 2:
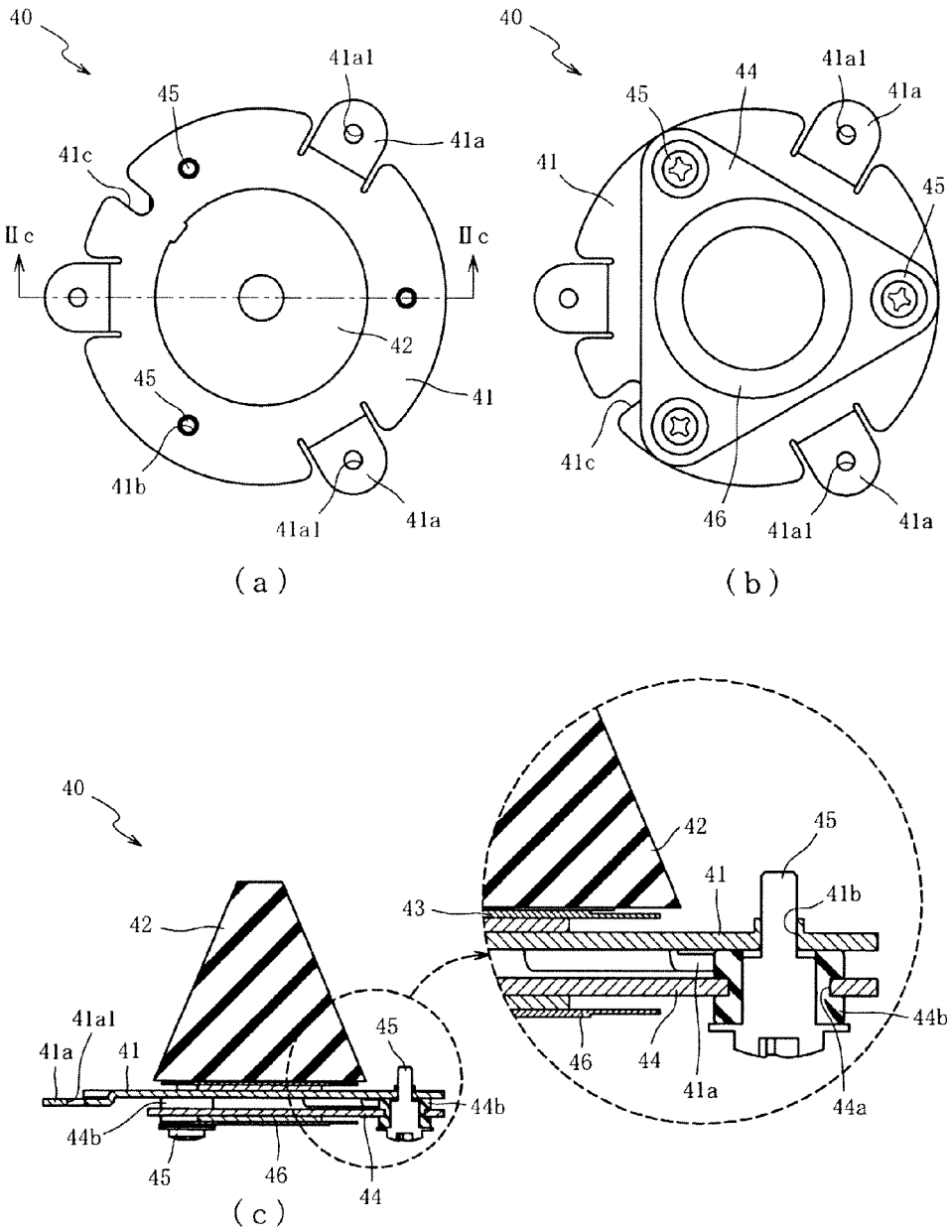
FIG. 2 (*a*) is a top plan view of a sensor section.

An embodiment of a sensor section 40 is described with reference to FIG. 2.

The sensor section 40 includes a first plate 41, a cushion 42, a head sensor 43, a second plate 44, connecting screws 45, and a rim sensor 46. The first plate 41 is affixed to the frame 30. The cushion 42 is disposed on the top surface side of the first plate 41. The head sensor 43 is provided between the first plate 41 and the cushion 42. The second plate 44 is disposed on the lower surface side of the first plate 41. The connecting screws 45 connect the second plate 44 to the first plate 41. The rim sensor 46 is attached to the lower surface of the second plate 44.

In an example embodiment, the first plate 41 is a plate-shaped member made of metal and formed in a circular plate shape. The first plate 41 has three affixing sections 41*a*, three connecting screw holes 41*b*, and a recessed section 41*c*. The affixing sections 41*a* protrude outward, in the radial direction of the first plate 41. The connecting screw holes 41*b* are provided between adjacent ones of the affixing sections 41*a*, in the circumferential direction of the first plate 41. The recessed section 41*c* has a concave shape receding from the outer periphery toward the center of the first plate 41.

The affixing sections 41*a* are configured to be mounted on the top ends of the protruded sections 32 of the frame 30 (see FIG. 1). In an example embodiment, the affixing sections 41*a* are formed at three locations, at equal intervals in the circumferential direction of the first plate 41. Each of the affixing sections 41*a* has an affixing screw hole 41*a*1 through which one of the affixing screws 40*a* can be passed (see FIG. 1). The affixing screw holes 41*a*1 are at locations corresponding to the female threaded sections 32*a* of the protruded sections 32 (see FIG. 1). The connecting screws 45 are engaged, in a screw-threading manner, with the connecting screw holes 41*b*. The inner circumferential surface of each of the connecting screw holes 41*b* has female threading that engages with the connecting screw 45. The recessed section 41*c* is configured to guide an output cable (not shown) downwardly. The output cable connects the head sensor 43 with a tone device (not shown) for outputting output signals from the head sensor 43 to the tone device.

In an example embodiment, the cushion 42 is a generally conical-shaped member made of an elastic material. The cushion 42 has a height dimension selected such that the upper end of the cushion 42, when the sensor section 40 is affixed to the main body 20, is located higher than the head 50 that is stretched over the main body 20 (see FIG. 3). Accordingly, the cushion 42 contacts the head 50 with a suitable pressure, when the head 50 is stretched over the main body 20.

The head sensor 43 comprises a device for detecting strikes on the head 50. The head sensor 43 includes a piezoelectric element. The upper surface side of the head sensor 43 (the upper side in FIG. 3 (*c*)) is directly adhered to the lower end surface of the cushion 42. Further, the lower surface side of the head sensor 43 (the lower side in FIG. 3 (*c*)) is adhered to the upper surface side of the first plate 41, for example, by a double-sided adhesive tape or other suitable adhering material.

In an example embodiment, the second plate 44 is a metal plate member that is formed generally in a triangular shape.

The second plate 44 has three connecting screw passing holes 44*a*, and three elastic members 44*b*. Each of the connecting screw passing holes 44*a* is provided adjacent to a respective one of the apexes. Each of the elastic members 44*b* is inserted in a respective one of the connecting screw passing holes 44*a*.

The connecting screw passing holes 44*a* are configured to allow the connecting screws 45 can be passed through. Each of the elastic members 44*b* is a circular ring-shaped member made of elastic material. The outer circumferential surface of each elastic member 44*b* is fitted in a respective one of the connecting screw passing holes 44*a*. Also, each of the elastic members 44*b* is provided with a dimension in the axial direction that is greater than the thickness of the second plate 44. Accordingly, the upper end and the lower end of each elastic member 44*b* inserted in the second plate 44 protrudes from the upper surface and from the lower surface of the second plate 44, respectively.

In particular embodiments, the elastic members 44*b* are made of a highly elastic rubber material with the modulus of repulsion elasticity being 50% or higher. In one example, the elastic members 44*b* are made of polychloroprene. However, in other embodiments, the elastic members 44*b* have other suitable elasticity values and/or are made of other suitable materials including, but not limited to styrene-butadiene rubber, polyurethane or the like.

The connecting screws 45 are inserted through the elastic members 44*b* from the lower surface side of the second plate 44, and are engaged, in a screw-threading manner, with the connection screw holes 41*b* of the first plate 41. Accordingly, the second plate 44 is connected to the first plate 41, through the elastic members 44*b*. As the connecting screws 45 are tightened in the connecting screw passing holes 44*a*, the elastic members 44*b* elastically deform, such that the second plate 44 is elastically supported with respect to the first plate 41.

The rim sensor 46 is a device for detecting strikes on the rim section 60. The rim sensor 46 includes a piezoelectric element and is adhered to the lower surface of the second plate 44, for example, by a double-sided adhesive tape.

Figure 3:
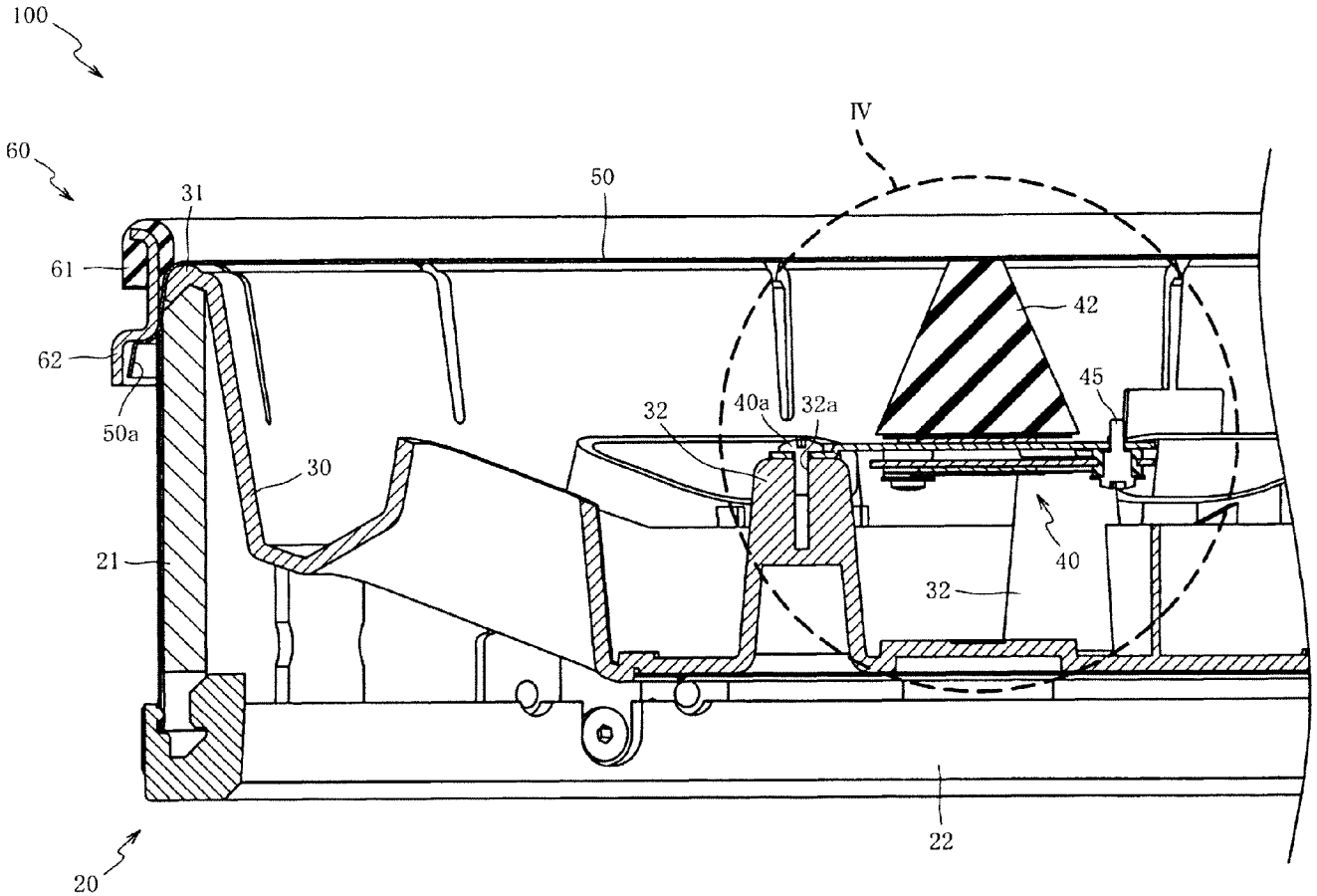
FIG. 3 is a partial, cross-sectional view of the electronic percussion instrument taken along a line III-III of FIG. 1.
Figure 4:
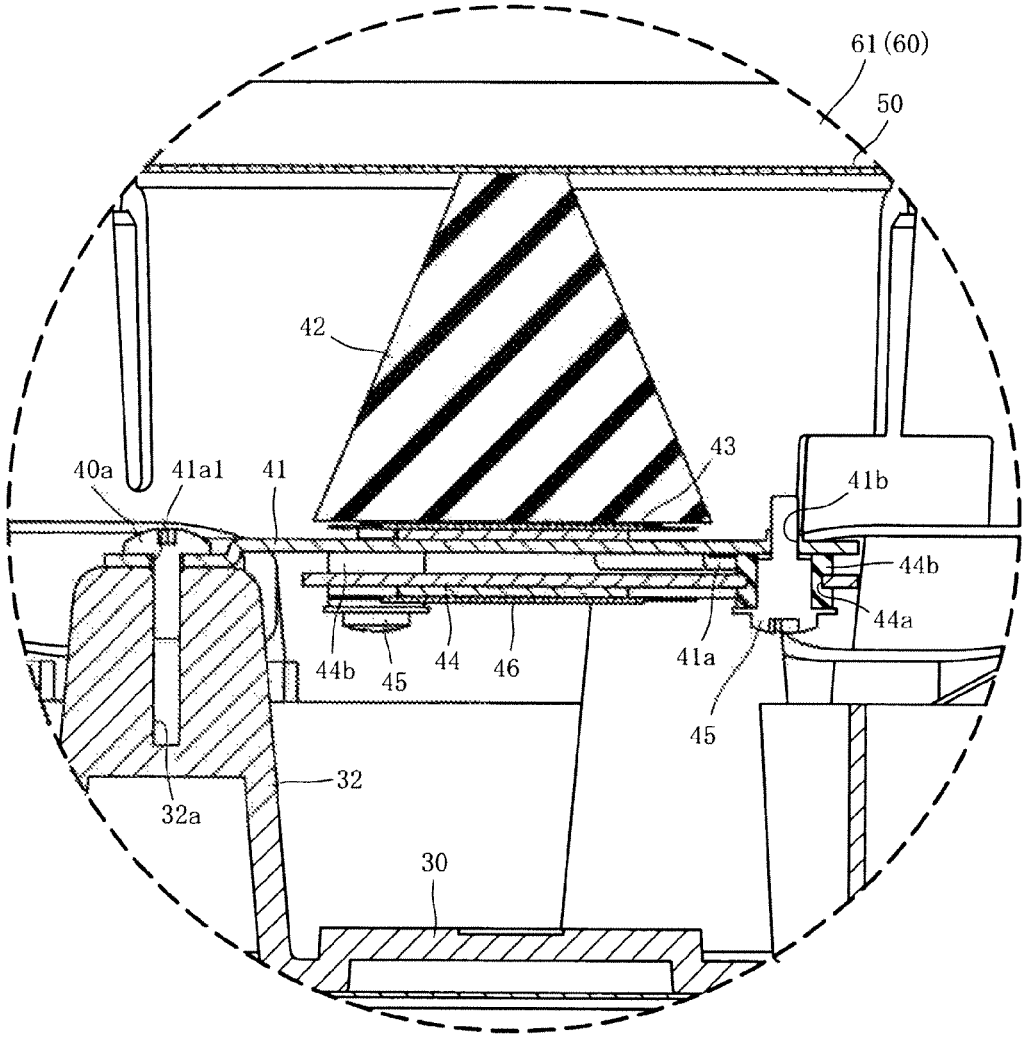
FIG. 4 is an enlarged view of a portion of the electronic percussion instrument, corresponding to the portion IV of FIG. 3.

Further structure of the electronic percussion instrument 100 is described with reference to FIG. 3 and FIG. 4, where FIG. 3 shows a view of a portion of, but not the entire electronic percussion instrument 100.

Affixing screw holes 41*a*1 are formed at the affixing sections 41*a* of the first plate 41. In addition, the protruded sections 32 of the frame 30 have the female threaded sections 32*a* formed therein. The affixing screws 40*a* are passed through the affixing screw holes 41*a*1, and are engaged, in a screw-threading manner, with the female threaded sections 32*a*, to affix the sensor section 40 to the frame 30. In this arrangement, the cushion 42 on the upper surface side of the first plate 41, is brought in pressure contact with the head 50. Further, the second plate 44 is elastically supported by the elastic members 44*b* on the lower surface side of the first plate 41.

When the head 50 is struck, a pressure that is generated by the impact on the head 50 acts on the cushion 42, and is detected by the head sensor 43. However, the elastic members 44*b* are disposed between the second plate and the first plate 41 that has the head sensor 43 attached thereto. Therefore, erroneous detection of the strike by the rim sensor 46 that is attached to the second plate 44, can be suppressed.

On the other hand, when the rim section 60 is struck, the frame 30 that is held and affixed between the rim section 60 and the cylindrical section 21 of the main body 20, vibrates. The vibrations of the frame 30 are transmitted through the protruded sections 32 in the central area of the frame 30, to the first plate 41 of the sensor section 40 affixed to the protruded sections 32. The vibrations transmitted to the first plate 41 are further transmitted to the second plate 44 that is elastically supported by the elastic members 44*b* on the lower surface side of the first plate 41, and the vibrations of the second plate 44 are detected by the rim sensor 46.

The second plate 44 is elastically supported on the first plate 41 through the elastic members 44*b*, such that the second plate 44 can vibrate, relatively freely. Therefore, the vibrations of the second plate 44 are amplified by the impact on the entire electronic percussion instrument 1 caused by the strike on the rim section 60. On the other hand, it is possible to suppress transmission to the second plate 44 of vibrations of other members, such as the frame 30, caused by the impact to the entire electronic percussion instrument 1 accompanying the strike on the rim section 60. Therefore, reliable output signals, having values depending on the force of strikes on the rim section 60, can be obtained from the rim sensor 46.

Also, the sensor section 40 is affixed to the protruded sections 32 located in the central area of the frame 30. Accordingly, differences in the detection result of the rim sensor 46, depending on the striking position where the rim section 60 is struck, can be suppressed.

In other words, if the rim sensor 46 were arranged at a position that is shifted from the center of the frame 30, then differences in sound output by a sound output device, such as a speaker or the like (not shown), would likely occur at different striking locations on the rim section 60, depending on the distance between the location of the rim sensor 46 and the striking location on the rim section 60, even when the rim section 60 is struck with the same force at the different striking locations. Also, differences in time lags from the moment of strike to the output of sound would likely occur, depending upon the striking location on the rim section 60.

In contrast, because the rim sensor 46 is disposed in the central area of the frame 30, the rim sensor 46 is also disposed in the center of the circular, ring-shaped rim section 60. Therefore, sound output that represents the striking force can be reliably provided irrespective of the striking location where the rim section 60 is struck. Moreover, the time lag from the moment of strike to the output of sound can be relatively constant and independent of the striking location.

Further, the elastic members 44*b* are inserted in the three screw passing holes 44*a* in the second plate 44, and the second plate 44 is elastically supported on the first plate 41 through the three elastic members 44*b*. Therefore, differences in output values of the rim sensor 46 at different striking position at the rim section 60 can be suppressed.

If the second plate 44 were elastically supported by the elastic members 44*b* at two locations, a substantial difference would occur in the ease of vibration of the second plate 44 between a portion elastically supported by the elastic member 44*b* (or a position in proximity of a linear line connecting the elastic members 44*b*) and a position spaced away from them. Even when the second plate 44 is elastically supported by the elastic members 44*b* at three or more locations, if the locations of the elastic members 44*b* were positioned linearly or at irregular intervals, similar differences in the ease of vibration of the second plate 44 would occur. Therefore, differences in the ease of vibration of the second plate 44, depending on the striking position where the rim section 60 is struck, would occur. As a result, significant differences would occur in the output values of the rim sensor 46, depending on the striking position and, thus, the ease of vibration of the second plate 44.

In contrast, with the elastic members 44*b* located at equal intervals in the circumferential direction, differences in the ease of vibration of the second plate 44 at positions where vibrations are transmitted, can be reduced. In other words, it is possible to reduce differences in the output values of the rim sensor 46 at different striking positions on the rim section 60. Therefore, irrespective of the striking positions on the rim section 60, the second plate 44 vibrates, reliably, corresponding to the striking force. As a result, vibrations of the frame 30 corresponding to the striking force at the rim section 60 can be reliably detected by the rim sensor 46.

In an example embodiment, the total contact area of the elastic members 44*b is equal to* ½ or less or, more preferably, ⅕ or less of the entire area of the upper surface of the second plate 44. By minimizing the contact area between the second plate 44 and the elastic members 44*b*, the second plate 44 can be elastically supported on the frame 30 and also be readily vibrated. Therefore, vibrations of the frame 30 corresponding to the striking force on the rim section 60, can be accurately detected by the rim sensor 46.

Moreover, because the first plate 41 is affixed to the frame 30, relative displacements of the first plate 41 with respect to the head 50 when the rim section 60 is struck, can be reduced. Accordingly, elastic deformation of the cushion 42 located between the first plate 41 and the head 50 can be reduced. Therefore, detection of the elastic deformation of the cushion 42 by the head sensor 43 can accordingly be suppressed. As a result, erroneous detection by the head sensor 43 when the rim section 60 is struck, can be suppressed.

In this manner, when the rim section 60 is struck, the second plate 44 is vibrated by the impact according to the force of strike, and the vibrations of the second plate 44 can be accurately detected by the rim sensor 46. On the other hand, erroneous detection by the head sensor 43 when the rim section 60 is struck, can be suppressed. Therefore, it is possible to obtain outputs from the head sensor 43 and the rim sensor 46 which accurately reflect the performance intention of the performer when the head 50 alone is struck, when the rim section 60 alone is struck, and when the head 50 and the rim section 60 are concurrently struck, respectively.

Also, the difference is greater between the case when the head 50 alone is struck and the case when the rim section 60 alone is struck. Therefore, when the tone device (not shown) performs a control for determining, based on an output value from the head sensor 43 and an output value from the rim sensor 46, which one of the head 50 and the rim section 60 has been struck, erroneous determinations by the tone device are more likely prevented.

Furthermore, when the frame 30 vibrates as the rim section 60 is struck, the cushion 42 is maintained in pressure-contact with the head 50. Accordingly, vibrations of the first plate 41 or the head 50 which continue after the rim section 60 has been struck can be quickly attenuated. Therefore, it is possible to suppress erroneous detection by the head sensor 43 or the rim sensor 46 of vibrations of the frame 30 or the head 50 which continue after the strike.

When external sound generated by a tone output device, such as a speaker, propagates through the air to the frame 30, the frame 30 may resonate and vibrate. Therefore, if the rim sensor 46 is directly adhered to the frame 30, the rim sensor 46 would likely erroneously detect vibrations of the frame 30 caused by the external sound.

Also, vibrations of the frame 30, which are generated when the rim section 60 is struck with sticks or the like, include not only vibrations generated by the impact of the strike but also vibrations caused by the striking sound generated when the rim section 60 is struck. The striking sound changes, depending on differences in the striking location and the striking angle of the sticks, when the rim section 60 is struck with the same striking force at the different striking locations or striking angles. For this reason, vibration of the frame 30 differs depending on the differences in the striking sound, resulting in output values of the rim sensor 46 that are unreliable.

In contrast, according to embodiments of the present invention, the sensor section 40 includes the elastic members 44*b* located between the first plate 41 and the second plate 44. Accordingly, fine vibrations of the frame 30 caused by external sound or striking sound generated when the rim section 60 is struck (hereafter referred to as "external sound or the like.") can be buffered by the elastic members 44*b*. Therefore, transmission to the second plate 44 of vibrations of the frame 30 caused by external sound or the like, can be reduced. As a result, erroneous detection of such vibrations by the rim sensor 46 can be suppressed.

Moreover, the lower end of the cushion 42 is attached to the frame 30, through the head sensor 43, while the upper end of the cushion 42 is in pressure contact with the head 50. Therefore, fine vibrations of the frame 30 caused by external sound or the like can be attenuated by the cushion 42. Further, the second plate 44 is elastically supported on the first plate 41, by the elastic members 44*b*. Therefore, vibrations of the first plate 41, which has been reduced by the cushion 42, can be further attenuated by the elastic members 44*b*. As a result, transmission of the vibrations to the second plate 44 can be reduced. Accordingly, it is possible to suppress erroneous detection by the rim sensor 46 of vibrations of the frame 30 caused by resonance that is generated from propagating external sound or the like.

Also, the second plate 46 is formed generally in a triangular shape, and the three elastic members 44*b* are located adjacent to the three apexes of the second plate, respectively. Therefore, the shape of the second plate 46 is relatively simple and the cost of making the second plate 46 can be minimized. Further, the surface area of the second plate 46 can be minimized relative to certain other shapes, such that vibrations of the second plate 46 that may be caused by external sound or the like can be minimized. As a result, erroneous detection by the rim sensor 46 of vibrations caused by external sound or the like can be suppressed.

In this manner, by disposing the elastic members 44*b* between the frame 30 and the second plate 44 that has the rim sensor 46 attached thereto, it is possible to inhibit erroneous detection by the rim sensor 46 of fine vibrations of the frame 30 caused by external sound or the like. However, relatively large vibrations of the frame 30 caused by strikes at the rim section 60 can be reliably detected by the rim sensor 46.

Figure 5:
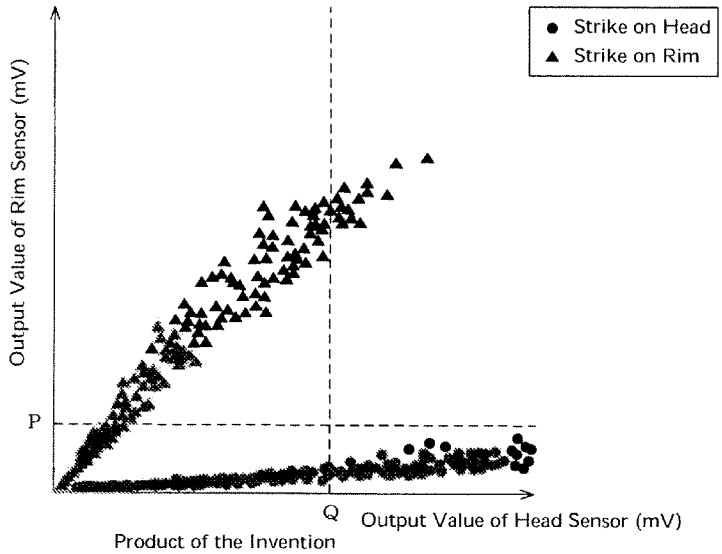
FIG. 5 (*a*) is a scatter-graph plotting the results of a striking test performed with an electronic percussion instrument in accordance with an embodiment of the invention.
Figure 5:
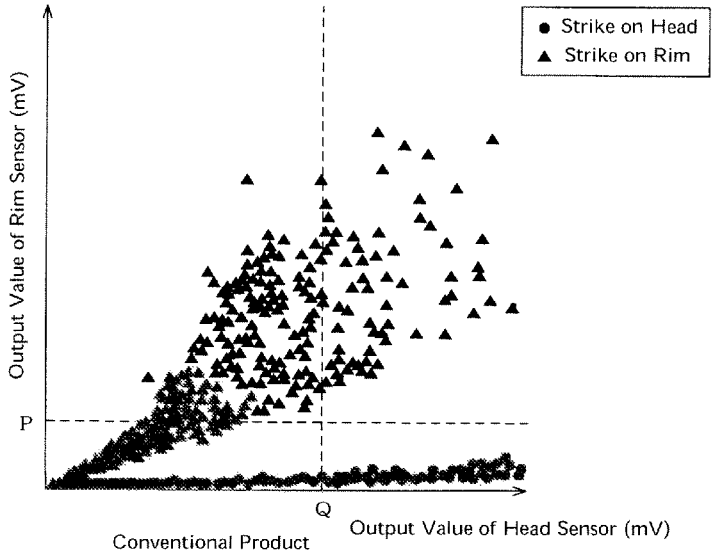

Results of striking tests conducted on the head 50 and the rim section 60 using the electronic percussion instrument 100 configured in a manner described above, are described with reference to FIG. 5. In the striking tests, an electronic percussion instrument 100 as described above (hereafter referred to as a "test embodiment of the invention"), and a comparison electronic percussion instrument (hereafter referred to as a "test comparison product") were subjected to measurements and compared.

The test comparison product included a sensor section having a configuration that was modified relative to the sensor section 40 of the test embodiment of the invention. More specifically, in the test embodiment of the invention, the first plate 41 with the head sensor 43 adhered thereto was affixed to the frame 30. In contrast, in the test comparison product, a first plate (corresponding to first plate 41) with a head sensor (corresponding to head sensor 43) attached thereto was elastically supported on a frame (corresponding to frame 30) through elastic members composed of elastic material. Also, in the test embodiment of the invention, the rim sensor 46 was attached to the second plate 44, and the second plate 44 was elastically supported on the first plate 41. In contrast, in the test comparison product, the rim sensor (corresponding to sensor 46) was directly adhered to a flat portion defined in the central area of the frame (corresponding to frame 30). Other components of the test comparison product, except the sensor section described above were the same as those of the test embodiment of the invention.

In the striking tests, output values of the head sensor 43 and the rim sensor 46 of the test embodiment of the invention were obtained upon striking the head 50 of the test embodiment of the invention. Those output values were compared with output values of the corresponding rim and head sensors 43 and 46 of the test comparison product that were obtained upon striking the head 50 of the test comparison product. In addition, output values of the head sensor 43 and the rim sensor 46 were obtained upon striking the rim section 60 of the test embodiment of the invention and those output values were compared with output values of the corresponding head sensor 43 and rim sensor 46 of the test comparison product that were obtained upon striking the rim section 60 of the test comparison product.

In the test embodiment of the invention and the test comparison product, a similar relation existed between the output values of the head sensor 43 and the rim sensor 46 upon striking the head 50. The output values of the head sensor 43 and the rim sensor 46 were generally proportional to the striking force at the head 50.

On the other hand, comparing the output values of the head sensor 43 with those of the rim sensor 46 at the time of striking the rim section 60, the output values of the head sensor 43, when the output value of the rim sensor 46 was at a predetermined value P, were smaller for the test embodiment of the invention, compared to the test comparison product. In other words, as compared to the test comparison product, the output values of the head sensor 43 in the test embodiment of the invention were reduced when the rim section 60 was struck.

In the test comparison product, the first plate with the head sensor 43 adhered thereto was elastically supported with respect to the frame 30, such that the first plate was relatively free to vibrate. Further, the period of vibration of the first plate was different from the period of vibration of the frame 30 and the head 50. As the first plate freely vibrated by strikes at the rim section 60, pressures due to elastic deformation of the cushion 42 located between the first plate and the head 50 changed. It is believed that the pressure change was detected by the head sensor 43.

On the other hand, in the test embodiment of the invention, the frame 30, the first plate 41, the head sensor 43, the cushion 42 and the head 50 vibrated integrally, when the rim section 60 is struck. Accordingly, pressure changes due to elastic deformation of the cushion 42 were suppressed. As a result, it is believed that the output values of the head sensor 43 of the test embodiment of the invention were reduced as compared to the test comparison product.

Also, the amount of scattering of the output values of the rim sensor 43, when the output value of the head sensor 43 was at a predetermined value Q, were reduced in the test embodiment of the invention, compared to the test comparison product. The output value of the head sensor 43 at the time of striking the rim section 60 became greater, with a greater magnitude of the striking force at the rim section 60. Accordingly, it can be assumed that the output value of the head sensor 43 was generally proportional to the striking force at the time of striking the rim section 60. As a result, it is believed that the scattering of the output values of the rim sensor 43 for a given striking force at the rim section 60, was reduced for the test embodiment of the invention, compared to the test comparison product. Accordingly, output values that more accurately corresponded to the striking forces at the rim section 60 were outputted by the test embodiment of the invention.

In the test comparison product, the rim sensor 46 was adhered directly to the frame 30. Accordingly, not only vibrations of the frame 30 that originated from the force of impact generated when the rim section 60 was struck, but also vibrations of the frame 30 that originated from the striking sound generated when the rim section 60 was struck, were detected by the rim sensor 46. The striking sound changed, depending on differences in the striking position, the striking angle of the stick and the like. As a result, the vibration of the frame 30 varied due to differences in the striking sound, which is believed to have led to a wider scattering in the output values of the rim sensor 46.

In contrast, in the test embodiment of the invention, the elastic members **44*b* were disposed between the first plate 41 and the second plate 44 with the rim sensor 46 attached thereto. Therefore, vibration of the frame 30 caused by the striking sound generated upon striking of the rim section 60, is attenuated by the elastic members 44*b*. On the other hand, the second plate 44 freely vibrated due to the impact generated upon striking the rim section 60, such that the rim sensor 46 provided output values corresponding to the striking force on the rim section 60**.

In this manner, in the test embodiment of the invention, erroneous detection by the head sensor 43 upon striking the rim section 60 was reduced, compared to the test comparison product. Therefore, it was possible to obtain outputs from the head sensor 43 and the rim sensor 46 which accurately reflected the intention of the performer when the head 50 alone was struck, when the rim section 60 alone was struck, and when the head 50 and the rim section 60 were concurrently struck, respectively. For example, when detected output values of the head sensor 43 and the rim sensor 46 are intermediate values between an output value assumed to be outputted upon striking the head 50 alone and an output value assumed to be outputted upon striking the rim section 60 alone, processing electronics (not shown) determines that both of the head 50 and the rim section 60 are struck. In this case, the ratio between the output value of the head sensor 43 and the output value of the rim sensor 46 upon striking both of the head 50 and the rim section 60 may be calculated, and tones may be generated based on the calculated ratio, such that tones corresponding to the performance intention of the performer can be outputted.

Also, in accordance with the test embodiment of the invention, detection of vibration of an impact generated at the time of striking the rim section 60 can be easier, while detection of vibrations generated by the striking sound at the time of striking the rim section 60 can be reduced. Accordingly, output values according to the striking forces at the time of striking the rim section 60 can be more accurately provided.

Figure 6:
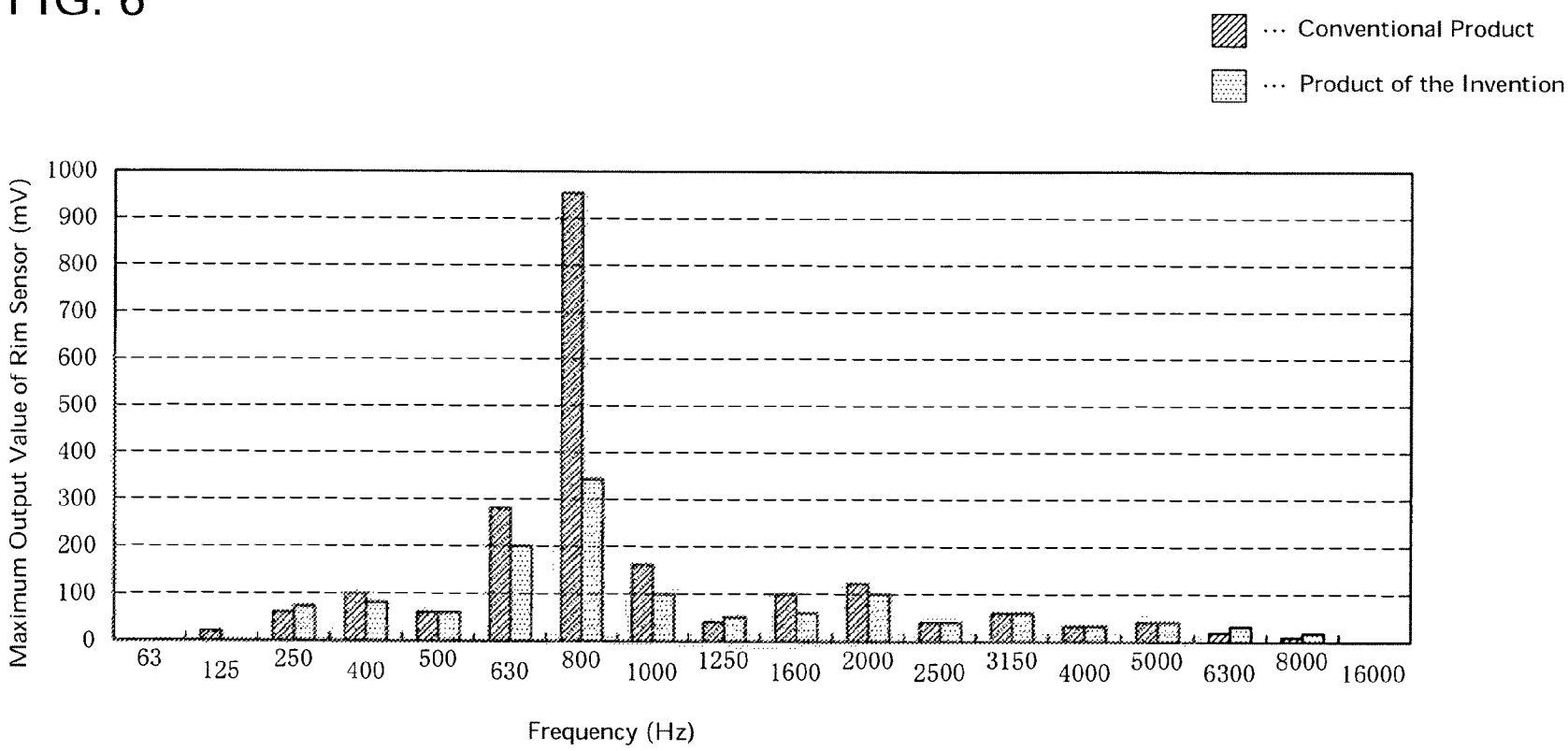
FIG. 6 is a graph showing the results of a detection test performed with rim sensors.

FIG. 6 shows results of a detection test conducted on the test embodiment of the invention, in which the rim sensor 46 detected external sounds. In the detection test, the test embodiment of the invention and the test comparison product were disposed at a position of 1 meter away from a monitor amplifier. A sine wave with a predetermined volume was outputted from the monitor amplifier, and maximum output values of the rim sensor 46 of each of the test embodiment of the invention and the comparison product were recorded.

In both the test embodiment of the invention and the test comparison product, when a sine wave at a frequency of 800 Hz was outputted from the monitor amplifier, the maximum output value of the rim sensor 46 reached a maximum value, as compared to other sine wave frequencies outputted from the monitor amplifier. The maximum output value of the rim sensor 46 in the test comparison product reached a level over 900 mV. However, the maximum output value of the rim sensor 46 in the test embodiment of the invention reached a level below 400 mV. In other words, the maximum output value of the rim sensor 46 in the test embodiment of the invention was reduced to more than half of that of the test comparison product. Also, at 630 Hz, 1000 Hz and 2000 Hz, where the maximum output value of the rim sensor 46 in the test comparison product exceeded 100 mV, the maximum output value of the rim sensor of the test embodiment of the invention was less than those of the test comparison product.

The frame 30 has a relatively large surface area. Accordingly, as sound emanated from the monitor amplifier propagates to the frame 30, the frame 30 would likely vibrate due to the sound. Therefore it is believed that output values of the rim sensor 46 became greater in the test comparison product, where the rim sensor 46 is directly adhered to the frame 30.

In contrast, the rim sensor 46 in the test embodiment of the invention, is adhered to the second plate 44 which has a smaller surface area than that of the frame 30. Accordingly, vibrations caused by sound emanated from the monitor amplifier had less of an influence on the second plate 44 in the test embodiment of the invention, as compared to the test comparison product. As a result, it is believed that output values of the rim sensor 46 of the test embodiment of the invention were reduced as compared to those of the test comparison product.

In this manner, in the test embodiment of the invention, the rim sensor 46 was adhered to the second plate 44, such that erroneous detection of external sound by the rim sensor 46 was suppressed, compared to the test comparison product.

The invention has been described above based on example embodiments. However, the invention need not be limited in any particular manner to the embodiments described above, and various improvements and changes can be made without departing from the subject matter of the invention.

For example, in embodiments described above, the first plate 41 of the sensor section 40 is affixed to the frame 30, and the second plate 44 is elastically supported on the first plate 41. However, in other embodiments of the invention, the first plate 41 may be omitted, and the second plate 44 may be elastically supported on the frame 30. In such embodiments, the material cost can be reduced, by the cost of the omitted first plate 41.

Also, in embodiments described above, the second plate 44 is connected to the first plate 41 by the connecting screws 45, with the elastic members **44*b* disposed between the first plate 41 and the second plate 44. However, in other embodiments of the invention, elastic members may be adhered to and between the first plate 41 and the second plate 44. In such embodiments, the connecting screws 45 can be omitted, and the material cost can be reduced, by the cost of the connecting screws 45**.

In embodiments described above, the second plate 44 is formed generally in a triangular shape. However, in other embodiments of the invention, the second plate may be formed in other suitable shapes, including, but not limited to a generally polygonal shape other than a triangle, a generally circular shape or other closed curve shape.

In embodiments described above, the first plate 41 and the second plate 44 are formed from a metal material. However, in other embodiments of the invention, the first plate 41 and/or the second plate 44 are formed from other suitable materials, such as, but not limited to a resin material or the like. Also, in embodiments described above, the frame 30 is made of a resin material. However, in other embodiments of the invention, the frame 30 may be made of other suitable materials, such as, but not limited to metal, ceramic, composite material, or the like.

In embodiments described above, the second plate 44 is elastically supported on the first plate 41 by three elastic members **44*b*. However, in other embodiments of the invention, the second plate 44 may be elastically supported on the first plate 41 by two or less elastic members 44*b* or four or more elastic members 44*b*. By using two or less elastic members 44*b*, the material cost and the manufacturing cost can be reduced. By using four or more elastic members 44*b*, the second plate 44 can be more stably supported with respect to the first plate 41**.

In embodiments described above, the head sensor 43 and the rim sensor 46 are disposed in the central area of the frame 30. However, in other embodiments of the invention, the head sensor 43 and the rim sensor 46 are disposed at a location other than the central area of the frame 30. In such embodiments, the degree of freedom in design can be enhanced. Also, the head sensor 43 and the rim sensor 46 may be disposed at different positions, respectively. For example, the second plate 44 having the rim sensor 46 adhered thereto, may be elastically supported on the first plate 41, and another plate independent of the first plate 41 may be affixed to the frame 30, where the head sensor 43 is adhered to that other plate.

The invention claimed is:

1. An electronic percussion instrument comprising:

a body section that is open on a first side thereof;

a head provided over the open, first side of the body section;

a rim that applies tension to the head and is affixed to the body section;

a rim sensor configured to detect striking on the rim;

a head sensor configured to detect striking on the head;

a plate member on which the rim sensor is attached; and an elastic member made of an elastic material, the elastic member being disposed between the plate member and the body section, and elastically supporting the plate member on the body section, wherein the elastic member is arranged to amplify vibrations of the plate member relative to the body section from a strike on the rim, and suppress transmission of vibrations of the body section to the plate member from the strike on the rim.

2. An electronic percussion instrument according to claim 1, further comprising a cushion formed from elastic material, wherein the body section includes a sensor connecting section that connects to the plate member through the elastic member, and wherein the cushion has one end attached to the sensor connecting section and another end in pressure contact with the head.

3. An electronic percussion instrument according to claim 2, wherein the body section has a cylindrical shape, and the rim sensor is disposed in a central section of the cylindrical shaped body section.

4. An electronic percussion instrument according to claim 3, wherein the plate member has a first surface having a total surface area, wherein the elastic member contacts a contact area on the first surface of the plate member, and wherein the contact area is ½ or less of the total surface area of the first surface of the plate.

5. An electronic percussion instrument according to claim 4, wherein the plate member is elastically supported by the elastic member at three or more positions located at equal intervals in a circumferential direction of the plate member.

6. An electronic percussion instrument according to claim 5, wherein the plate member has a triangular shape with apexes, and the elastic member abuts against the plate member at each of the apexes.

7. An electronic percussion instrument according to claim 1, wherein the body section has a cylindrical shape, and the rim sensor is disposed in a central section of the cylindrical shaped body section.

8. An electronic percussion instrument according to claim 1, wherein the elastic member is in contact with the plate member and dampens vibrations between the body section and the plate member.

9. An electronic percussion instrument according to claim 1, wherein the plate member is supported by the elastic member in a position in which the plate member is spaced apart from and out of direct contact with the body.

10. An electronic percussion instrument according to claim 1, further comprising a further plate member on which the head sensor is attached, wherein the elastic member is arranged between and in contact with the plate member on which the rim sensor is attached and the further plate member on which the head sensor is attached.

11. An electronic percussion instrument according to claim 1, further comprising a further plate member on which the head sensor is attached, wherein:

the plate member on which the rim sensor is attached has a first surface facing the further plate member;

the further plate member on which the head sensor is attached has a second surface facing the plate member on which the rim sensor is attached, the elastic member is arranged between the first surface of the plate member on which the rim sensor is attached and the second surface of the further plate member on which the head sensor is attached.

12. An electronic percussion instrument according to claim 1, further comprising a further plate member on which the head sensor is attached, wherein the plate member on which the rim sensor is attached is elastically supported below and by the further plate member through the elastic member, and can vibrate relative to the further plate member.

13. An electronic percussion instrument according to claim 1, wherein the elastic material has a greater elasticity than the plate member.

14. An electronic percussion instrument, comprising:

a body section that is open on a first side thereof;

a head provided over the open, first side of the body section;

a rim that applies tension to the head and is affixed to the body section;

a rim sensor configured to detect striking on the rim;

a head sensor configured to detect striking on the head;

a plate member on which the rim sensor is attached; and an elastic member made of an elastic material, the elastic member being disposed between the plate member and the body section, and elastically supporting the plate member on the body section;

wherein the plate member has a first surface having a total surface area, wherein the elastic member contacts a contact area on the first surface of the plate member, and wherein the contact area is ½ or less of the total surface area of the first surface of the plate.

15. An electronic percussion instrument according to claim 14, wherein the plate member is elastically supported by the elastic member at three or more positions located at equal intervals in a circumferential direction of the plate member.

16. An electronic percussion instrument according to claim 15, wherein the plate member has a triangular shape with apexes, and the elastic member abuts against the plate member at each of the apexes.

17. An electronic percussion instrument according to claim 2, wherein the plate member has a first surface having a total surface area, wherein the elastic member contacts a contact area on the first surface of the plate member, and wherein the contact area is ½ or less of the total surface area of the first surface of the plate.

18. An electronic percussion instrument according to claim 17, wherein the plate member is elastically supported by the elastic member at three or more positions located at equal intervals in a circumferential direction of the plate member.

19. An electronic percussion instrument according to claim 18, wherein the plate member has a triangular shape with apexes, and the elastic member abuts against the plate member at each of the apexes.

20. An electronic percussion instrument comprising:

a body section;

a head supported on a first side of the body section;

a rim arranged in a fixed relation with the body section;

a rim sensor configured to detect striking on the rim;

a plate member on which the rim sensor is attached; and at least one elastic member disposed between the plate member and the body section, and elastically supporting the plate member on the body section, wherein the elastic material has a greater elasticity than the plate member.

21. An electronic percussion instrument according to claim 20, further comprising a further plate member on which the head sensor is attached, wherein the plate member on which the rim sensor is attached is elastically supported below and by the further plate member through the elastic member, and can vibrate relative to the further plate member.

22. An electronic percussion instrument according to claim 20, wherein the plate member is supported, through the elastic member for vibration relative to the body section, the elastic member arranged to amplify plate member vibration from an impact on the rim, and suppress transmission of vibrations from the body section to the plate member.

23. A method of making an electronic percussion instrument comprising:

providing a body section that is open on a first side thereof;

disposing a head over the open, first side of the body section;

applying tension to the head with a rim affixed to the body section;

providing a rim sensor to detect a strike on the rim;

providing a head sensor to detect a strike on the head;

attaching the rim sensor to a plate member; and disposing at least one elastic member made of an elastic material between the plate member and the body section, and elastically supporting the plate member on the body section through the at least one elastic member, including arranging the elastic member to amplify vibrations of the plate member relative to the body section from a strike on the rim, and suppress transmission of vibrations of the body section to the plate member from the strike on the rim.

24. A method according to claim 23, further comprising connecting a sensor connecting section to the plate member through the at least one elastic member, attaching one end of a cushion formed from an elastic material to the sensor connecting section, arranging the second end of the cushion in pressure contact with the head.

25. A method according to claim 23, wherein the body section has a cylindrical shape, the method further comprising disposing the rim sensor in a central section of the cylindrical shaped body section.

26. A method according to claim 23, wherein the plate member has a first surface having a total surface area, wherein the elastic member contacts a contact area on the first surface of the plate member, and wherein the contact area is ½ or less of the total surface area of the first surface of the plate.

27. A method according to claim 23, further comprising elastically supporting the plate member by the at least one elastic member at three or more positions located at equal intervals in a circumferential direction of the plate member.

28. A method according to claim 23, wherein the plate member has a triangular shape with apexes, and the at least one elastic member comprises three elastic members that abut against the plate member at the apexes, respectively.

29. A method according to claim 23, further comprising attaching the head sensor to a further plate member, and elastically supporting the plate member on which the rim sensor is attached below and by the further plate member through the elastic member, for vibration relative to the further plate member.

30. A method according to claim 23, wherein the elastic material has a greater elasticity than the plate member.

* * * * *